US007891341B2

(12) United States Patent
Inoue et al.

(10) Patent No.: US 7,891,341 B2
(45) Date of Patent: Feb. 22, 2011

(54) CONTROL DEVICE FOR INTERNAL COMBUSTION ENGINE

(75) Inventors: Toshio Inoue, Gotenba (JP); Osamu Harada, Toyota (JP); Shunsuke Fushiki, Susono (JP); Daigo Ando, Nisshin (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 12/513,509

(22) PCT Filed: Jul. 13, 2007

(86) PCT No.: PCT/JP2007/064386

§ 371 (c)(1),
(2), (4) Date: May 5, 2009

(87) PCT Pub. No.: WO2008/062584

PCT Pub. Date: May 29, 2008

(65) Prior Publication Data

US 2009/0276144 A1 Nov. 5, 2009

(30) Foreign Application Priority Data

Nov. 20, 2006 (JP) ..... 2006-312754

(51) Int. Cl.
*F02M 33/02* (2006.01)
*F02M 69/54* (2006.01)

(52) U.S. Cl. ..... 123/457; 123/511; 123/515; 123/520

(58) Field of Classification Search ..... 123/431, 123/516, 299, 300, 304, 575, 456, 457, 510, 123/511, 514, 515, 520
See application file for complete search history.

(56) References Cited

U.S. PATENT DOCUMENTS 4,732,131 A * 3/1988 Hensel ..... 123/516
5,095,880 A * 3/1992 Ricks ..... 123/516
7,013,872 B2 * 3/2006 Yamazaki et al. ..... 123/431

(Continued)

FOREIGN PATENT DOCUMENTS

JP 8 68355 3/1996

(Continued)

*Primary Examiner*—Hai H Huynh
(74) *Attorney, Agent, or Firm*—Oblon, Spivak, McClelland, Maier & Neustadt, L.L.P.

(57) ABSTRACT

A fuel supply system includes a first non-return valve for a low-pressure delivery connection pipe and a second non-return valve for a pump supply pipe. The former non-return pipe does not allow fuel to flow from the low-pressure delivery pipe to the low-pressure supply pipe. The second non-return valve does not allow fuel to flow from pump supply pipe to the low-pressure supply pipe. Upon determining that air purging is necessary, an engine ECU operates a feed pump for approximately one second and then opens, for dummy injection, an in-cylinder injector and an intake manifold injector.

10 Claims, 10 Drawing Sheets

U.S. PATENT DOCUMENTS

| | | | | |
|---|---|---|---|---|
| 7,073,486 | B2 * | 7/2006 | Nomura et al. | 123/446 |
| 7,093,583 | B2 * | 8/2006 | Inoue et al. | 123/446 |
| 7,107,968 | B2 * | 9/2006 | Nomura | 123/456 |
| 7,178,506 | B2 * | 2/2007 | Kojima et al. | 123/431 |
| 7,201,145 | B2 * | 4/2007 | Matsumura | 123/430 |
| 7,263,972 | B2 * | 9/2007 | Tokuda et al. | 123/431 |
| 7,263,973 | B2 * | 9/2007 | Akita et al. | 123/431 |
| 7,328,684 | B2 * | 2/2008 | Saito et al. | 123/299 |
| 7,328,687 | B2 * | 2/2008 | Kojima | 123/431 |
| 7,331,328 | B2 * | 2/2008 | Mashiki | 123/431 |
| 7,341,043 | B2 * | 3/2008 | Kurata et al. | 123/431 |
| 7,353,798 | B2 * | 4/2008 | Tokuda et al. | 123/295 |
| 7,380,537 | B2 * | 6/2008 | Yamaguchi et al. | 123/299 |
| 7,380,539 | B2 * | 6/2008 | Akita et al. | 123/431 |
| 7,389,766 | B2 * | 6/2008 | Akita et al. | 123/431 |
| 7,500,469 | B2 * | 3/2009 | Akita | 123/431 |
| 7,698,054 | B2 * | 4/2010 | Akita et al. | 701/113 |
| 7,789,071 | B2 * | 9/2010 | Akita et al. | 123/447 |
| 2005/0072405 | A1 | 4/2005 | Kojima et al. | |
| 2006/0231080 | A1 * | 10/2006 | Tomatsuri et al. | 123/516 |

FOREIGN PATENT DOCUMENTS

| | | | |
|---|---|---|---|
| JP | 8 158979 | | 6/1996 |
| JP | 9 151827 | | 6/1997 |
| JP | 2003 56423 | | 2/2003 |
| JP | 2003-166435 | * | 6/2003 |
| JP | 2005 106027 | | 4/2005 |
| JP | 2005 315174 | | 11/2005 |
| JP | 2006 207453 | | 8/2006 |
| JP | 2006 220112 | | 8/2006 |

* cited by examiner

CONTROL DEVICE FOR INTERNAL COMBUSTION ENGINE

TECHNICAL FIELD

The present invention relates to a control device for a fuel system of an internal combustion engine that includes a fuel injection mechanism for injecting fuel into a cylinder at a high pressure (in-cylinder injector) as well as a fuel injection mechanism for injecting fuel into an intake manifold or an intake port (intake manifold injector). More particularly, the present invention relates to a technique of discharging air having entered a fuel pipe.

BACKGROUND ART

An engine is known that has a first fuel injection valve for injecting fuel into a combustion chamber of the gasoline engine (in-cylinder injector) and a second fuel injection valve for injecting fuel into an intake manifold (intake manifold injector), and changes the fuel injection ratio between the in-cylinder injector and the intake manifold injector according to the engine speed or engine load.

In a low-pressure fuel system including the intake manifold injector (intake manifold injector and pipe), a feed pump is used to supply fuel to the intake manifold injector via a low-pressure-system delivery pipe, and the intake manifold injector injects the fuel into the intake manifold for each cylinder of the engine. In a high-pressure fuel system including the in-cylinder injector (in-cylinder injector and pipe), fuel supplied from the feed pump to a high-pressure fuel pump has its pressure increased by the high-pressure fuel pump and is supplied via a high-pressure delivery pipe to the in-cylinder injector, and the in-cylinder injector injects the high-pressure fuel into a combustion chamber for each cylinder of the engine. Here, the pressure of the fuel generated by the feed pump (feed pressure) is approximately 400 kPa, and the pressure of the fuel generated by the high-pressure fuel pump operated by a cam provided to the driveshaft coupled to the crankshaft of the engine is approximately 4 MPa to 13 Mpa.

Supposing that a fuel tank has become empty (the state of so-called "out of gas") and the engine is to be started. In this state, air may have collected in a fuel pipe (delivery pipe) used for supplying the fuel to the two types of injectors. Therefore, at the time immediately after the start of fuel injection from each injector, the fuel cannot be injected normally in an "air purge period" which is a period until the air is purged from the fuel delivery pipe.

Japanese Patent Laying-Open No. 2006-207453 discloses a control device for an internal combustion engine including an in-cylinder injector and an intake manifold injector, for smoothing operation in the process of a change from an engine start period to normal operation, regardless of air collecting in the pipe. The control device is a control device for the internal combustion engine including a plurality of cylinders classified into a plurality of groups and including, for each cylinder, a first fuel injection mechanism for injecting fuel into a combustion chamber and a second fuel injection mechanism for injecting fuel into an intake manifold. The control device includes: a start period fuel injection control unit injecting fuel to each cylinder by selectively using only one of the first fuel injection mechanism and the second fuel injection mechanism in a start period of the internal combustion engine; a determination unit determining, at the start of the internal combustion engine; whether air has collected in each of first and second fuel supply systems for delivering fuel respectively to the first and second fuel injection mechanisms; a first fuel injection control unit injecting fuel to a part of the plurality of groups, using only one of the fuel injection mechanisms that is selected by the start period fuel injection control unit, in a predetermined period from the end of the start period in the case where the determination unit determines that air has collected, and a second fuel injection control unit injecting fuel to the remaining groups other than the part of the plurality of groups, with both of the first and second fuel injection mechanisms available, at a fuel injection ratio that is set based on a condition required for the internal combustion engine, in a predetermined period in the case where the determination unit determines that air has collected.

With the control device for the internal combustion engine, the fuel injection is controlled such that fuel is injected using only one of the fuel injection mechanisms (injectors) to each cylinder in the start period of the internal combustion engine. In the case where air may have collected in the fuel supply system, in the process of change from the end of the start period to the normal operation, start of fuel injection from the other fuel injection mechanism (injector) is not allowed for all cylinders simultaneously and is allowed for only a part of the cylinders. For the remaining cylinders, fuel injection using the one of the fuel injection mechanisms (injectors) that is used in the start period is continued. Therefore, even if fuel injection failure occurs due to influences of the accumulating air immediately after the use of the other fuel injection mechanism (injector) is started, reduction of the output of the whole internal combustion engine can be suppressed. As a result, a sudden decrease of the engine output can be prevented that is caused when the air is purged from the fuel supply system in the process of change from the start period (at the time of engine start or idling) to the normal operation, and accordingly the operating state can be made stable.

A feed pump provided at a fuel tank is used to supply fuel to a low-pressure-system delivery pipe for supplying fuel to the intake manifold injector and to a high-pressure-system delivery pipe for supplying fuel to the in-cylinder injector, and any one of the injectors (the injector of the low-pressure system for example) is opened (dummy injection) to purge air (here, the high-pressure fuel pump driven by the internal combustion engine is not driven at the time of the dummy injection). At this time, the air compressed in the other delivery pipe (the high-pressure-system delivery pipe which does not perform the dummy injection) expands until reaching normal pressure. The expanding air causes the fuel to be pushed out into the low-pressure fuel system communicating with the high-pressure fuel system. Therefore, from the low-pressure-system intake manifold injector from which air is to be purged, fuel could be emitted together with the air.

Japanese Patent Laying-Open No. 2006-207453, however, does not mention such fuel emission due to the dummy injection performed for discharging the collecting air.

DISCLOSURE OF THE INVENTION

The present invention has been made to solve the above-described problem, and an object of the invention is to provide a control device for an internal combustion engine including two fuel supply pipe systems that can discharge collecting air in the two pipe systems without causing fuel emission.

A control device according to the present invention controls an internal combustion engine including a first fuel injection mechanism injecting fuel into a cylinder and a second fuel injection mechanism injecting fuel into an intake manifold. The control device includes: a pump control unit controlling a fuel pump for supplying fuel to the first fuel injection mechanism and the second fuel injection mechanism; a control unit controlling to open the fuel injection mechanism by operating the fuel pump to purge air from at least one of a first fuel pipe from the fuel pump to the first fuel injection mechanism and a second fuel pipe from the fuel pump to the second fuel injection mechanism; and a break unit breaking, when one of the first fuel injection mechanism and the second fuel injection mechanism is opened, a state of communication where the fuel pipe to the opened one fuel injection mechanism and the fuel pipe to the other fuel injection mechanism communicate with each other.

According to the present invention, the fuel pump is used to supply fuel to the fuel pipes of the two systems (here, the first fuel pipe from the fuel pump to the first fuel injection mechanism and the second fuel pipe from the fuel pump to the second fuel injection mechanism), and one of the fuel injection mechanisms (second fuel injection mechanism for example) is opened (dummy injection) to purge air. At this time, if compressed air has collected in the first fuel pipe of the other fuel injection mechanism (here, the first fuel injection mechanism that does not perform dummy injection), the air expands to normal pressure. Even if the expanded air is to push out the fuel in the first fuel pipe toward the second fuel pipe, the break unit does not allow the fuel to flow from the first fuel pipe to the second fuel pipe. Therefore, the fuel can be prevented from being emitted in addition to the air from the second fuel injection mechanism which performs the dummy injection for purging the air therefrom. Here, the fuel injection mechanism performing the dummy injection and the fuel pipe in which the air has an increased pressure to normal pressure to push out the fuel may be the other one of the fuel injection mechanisms and the other one of the fuel pipes respectively. In this way, the control device for the internal combustion engine can be provided that can discharge air collecting in the fuel supply pipes of two systems without causing fuel emission in the internal combustion engine having the fuel supply pipes of the two systems.

Preferably, the break unit is configured with a break valve provided to at least one of the first fuel pipe and the second fuel pipe and located between the fuel injection mechanisms and a branching point where a pipe from a fuel tank branches into the first fuel pipe and the second fuel pipe, for inhibiting fuel from flowing in a direction from the fuel injection mechanisms toward the branching point.

According to the present invention, for example, the fuel does not flow from the fuel pipe of the second fuel injection mechanism to the fuel pipe of the first fuel injection mechanism through the branching point (where the pipe branches into the first fuel pipe and the second fuel pipe). Therefore, fuel does not flow from the first fuel pipe to the second fuel pipe, and the fuel can be prevented from being emitted, in addition to the air, from the second fuel injection mechanism which performs the dummy injection for purging air. Here, the fuel injection mechanism performing the dummy injection and the fuel pipe in which the air has an increased pressure to normal pressure to push out the fuel may be the other one of the fuel injection mechanisms and the other one of the fuel pipes respectively. In this way, the air collecting in the fuel supply pipes of the two systems can be discharged without causing fuel emission in the internal combustion engine including the fuel supply pipes of the two systems.

More preferably, the control unit opens the first fuel injection mechanism and the second fuel injection mechanism at different times such that one of the first and second fuel injection mechanisms is opened later than the other. The break valve is provided to the fuel pipe to the fuel injection mechanism opened later.

According to the present invention, in the fuel pipe from which the air is purged first, there is no collecting air. Therefore, the break valve is provided not to the fuel pipe from which the air is purged first (it is supposed here that the air is purged from the second fuel pipe first), but to only the fuel pipe from which the air is purged next (first fuel pipe). In the case where the air is purged first from the second fuel pipe, the compressed air, if collecting in the first fuel pipe, expands to normal pressure. Even if the expanding air is to push out the fuel in the first fuel pipe toward the second fuel pipe, the break valve provided at the first fuel pipe inhibits the fuel from flowing from the first fuel pipe to the second fuel pipe. Therefore, the dummy injection of the second fuel injection mechanism discharges the air only, and the air collecting in the second fuel pipe from which the air is purged first is removed. When air is to be purged from the first fuel pipe, the fuel in the second fuel pipe is not pushed toward the first fuel pipe since air does not collect in the second fuel pipe. Namely, a break valve for the second fuel pipe is unnecessary. Thus, one break valve can be used to prevent fuel from being emitted in addition to the air from the first fuel injection mechanism and the second fuel injection mechanism from which air is to be purged.

Still preferably, the break valve is a non-return valve inhibiting fuel from flowing in a direction from the fuel injection mechanisms toward the branching point.

According to the present invention, the non-return valve can be used to prevent fuel from being emitted in addition to the air from any of the fuel injection mechanisms.

Still preferably, the control unit controls to open the fuel injection mechanisms at different times such that the second fuel injection mechanism is opened earlier than the first fuel injection mechanism. A non-return valve provided on an output side of a high-pressure fuel pump provided to the first fuel pipe additionally serves as the break valve.

According to the present invention, usually the first fuel pipe of the high-pressure system is provided with the high-pressure fuel pump (operated for example by a cam provided to the driveshaft coupled to the engine crankshaft), and the non-return valve (called check valve with leakage function) is provided on the output side of the high-pressure fuel pump for preventing backflow of the high pressure system. This non-return valve can be used to additionally serve as the break valve that has to be provided, not to the fuel pipe from which the air is purged first (it is supposed here that the air is purged first from the second fuel pipe), but only to the fuel pipe from which the air is to be purged later (first fuel pipe). Therefore, a new non-return valve (break valve) is unnecessary and increase of the cost can be avoided.

Still preferably, the break unit is configured to include: an open/close valve capable of making a switch between a state of allowing fuel to flow, and a state of inhibiting fuel from flowing, in a direction from the fuel injection mechanisms toward a branching point where a pipe from a fuel tank branches into the first fuel pipe and the second fuel pipe; and an open/close valve control unit controlling the open/close valve such that the states of the open/close valve are switched.

According to the prevent invention, the open/close valve, not the non-return valve, can be used as the break valve to prevent fuel from being emitted in addition to the air from any of the fuel injection mechanisms.

Still preferably, the break unit is configured to include: a three-way valve provided at a branching point where a pipe from a fuel tank branches into the first fuel pipe and the second fuel pipe; and a three-way valve control unit controlling the three-way valve such that the three-way valve has any of a state where fuel flows from the fuel tank to the first fuel pipe only, a state where fuel flows from the fuel tank to the second fuel pipe only and a state where fuel flows from the fuel tank to the first fuel pipe and the second fuel pipe.

According to the present invention, in the case where the dummy injection is used to purge air from the second fuel injection mechanism, the three-way valve is switched to the state where fuel flows from the fuel tank to the second fuel pipe only. At this time, since fuel does not flow from the first fuel pipe to the second fuel pipe, even if there is air in the first fuel pipe and the air is expanded, the fuel does not flow from the first fuel pipe to the second fuel pipe. Thus, fuel can be prevented from being emitted from the second fuel injection mechanism in addition to the air. In the case where the dummy injection is used to purge air from the first fuel injection mechanism, the three-way valve is switched to the state where fuel flows from the fuel tank to the first fuel pipe only. At this time, since the fuel does not flow from the second fuel pipe to the first fuel pipe, even if there is air in the second fuel pipe and the air is expanded, the fuel does not flow from the second fuel pipe to the first fuel pipe. Thus, fuel can be prevented from being emitted from the first fuel injection mechanism in addition to the air.

BEST MODES FOR CARRYING OUT THE INVENTION

Figure 1:
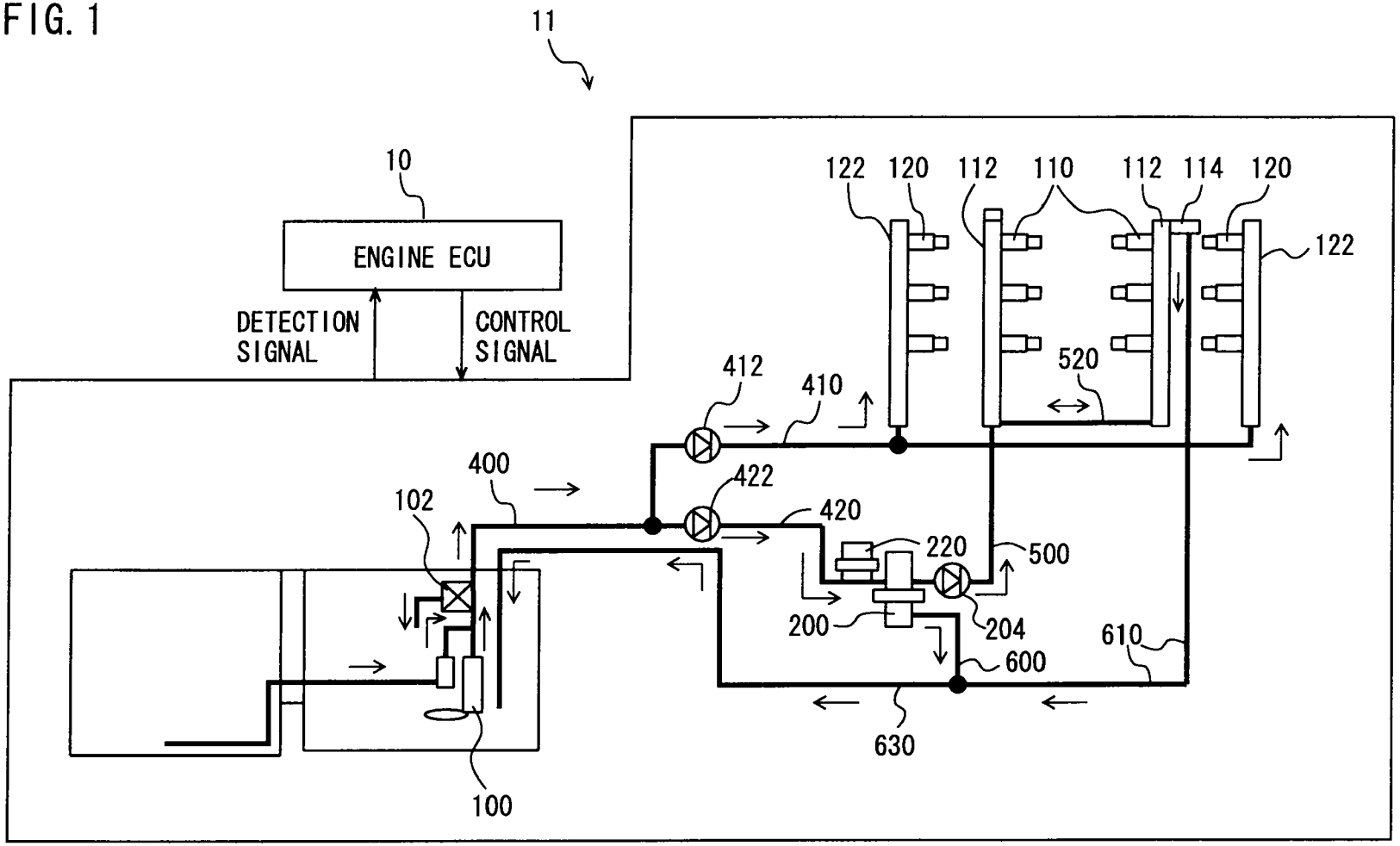
FIG. 1 is a schematic diagram of the whole fuel supply system for a gasoline engine that is controlled by a control device according to a first embodiment of the present invention.

Embodiments of the present invention will be described with reference to the drawings. In the following description, like components are denoted by like reference characters. The components are named identically and also function identically. Therefore, a detailed description thereof will not be repeated.

First Embodiment

FIG. 1 shows a fuel supply system 11 of an engine controlled by an engine ECU (Electronic Control Unit) 10 that is the control device according to the present embodiment. The engine is a V-type 6-cylinder gasoline engine, and has in-cylinder injectors 110 for injecting the fuel into respective cylinders and intake manifold injectors 120 for injecting the fuel into the intake manifold for respective cylinders. It is noted that the present invention is not applied exclusively to such an engine, and may be applied to a gasoline engine of another type (such as V-type 8-cylinder engine, in-line 6-cylinder engine, in-line 4-cylinder engine). Further, the number of high-pressure fuel pumps is not restricted to one, but may be more than one pump.

As shown in FIG. 1, fuel supply system 11 includes a feed pump 100 provided to a fuel tank for supplying fuel at a discharge pressure which is a low pressure (a set pressure of a pressure regulator 102), a high-pressure fuel pump 200 driven by a cam provided to a driveshaft coupled to a crankshaft of the engine, a high-pressure delivery pipe 112 provided for each of left and right banks for supplying high-pressure fuel to in-cylinder injectors 110, three in-cylinder injectors 110 for each of the left and right banks, provided at the corresponding high-pressure delivery pipe 112, a low-pressure delivery pipe 122 provided for each of the left and right banks for supplying fuel to intake manifold injectors 120, and three intake manifold injectors 120 for each of the left and right banks, provided at the corresponding low-pressure delivery pipe 122.

Pressure regulator 102 is provided at the discharge port of feed pump 100 of the fuel tank. Pressure regulator 102 is connected to engine ECU 10 which can change the set pressure of pressure regulator 102. The set pressure may be approximately 300 kPa to 700 kPa, for example (this pressure is set in most cases to approximately 400 kPa). When the pressure of the fuel discharged from feed pump 100 reaches a level equal to or greater than the level set by pressure regulator 102, the fuel corresponding to the excess pressure is returned to the fuel tank as the relief fuel. Since pressure regulator 102 is provided within the fuel tank to obtain such relief fuel, the fuel heated as it passes through the engine room is less likely to return to the fuel tank, so that generation of evaporation gas within the fuel tank is suppressed. It is noted that pressure regulator 102 may be provided at the distal end of low-pressure delivery pipe 122, instead of being provided within the fuel tank.

The discharge port of feed pump 100 of the fuel tank is connected to a low-pressure supply pipe 400, and low-pressure supply pipe 400 is branched into a low-pressure delivery connection pipe 410 and a pump supply pipe 420. Low-pressure delivery connection pipe 410 is connected to low-pressure delivery pipe 122 of one of the V-shaped banks and to low-pressure delivery pipe 122 of the other bank.

Pump supply pipe 420 is connected to an intake port of high-pressure fuel pump 200. A pulsation damper 220 is provided immediately upstream of the intake port of high-pressure fuel pump 200, so as to reduce fuel pulsation.

The discharge port of high-pressure fuel pump 200 is connected to a high-pressure delivery connection pipe 500, and high-pressure delivery connection pipe 500 is connected to high-pressure delivery pipe 112 of one of the V-shaped banks. High-pressure delivery pipe 112 of one bank and high-pressure delivery pipe 112 of the other bank are connected via a high-pressure connection pipe 520.

A relief valve 114 provided at high-pressure delivery pipe 112 is connected via a high-pressure delivery return pipe 610 to a high-pressure fuel pump return pipe 600. High-pressure fuel pump 200 is connected to high-pressure fuel pump return pipe 600. High-pressure fuel pump return pipe 600 is connected to return pipe 630 and connected to the fuel tank.

High-pressure fuel pump 200 has, as its main components, a pump plunger driven by a cam to slide up and down, an electromagnetic spill valve and a check valve 204 provided with a leakage function.

While the pump plunger is moved downward by the cam and the electromagnetic spill valve is opened, the fuel is taken in (suctioned). While the pump plunger is moved upward by the cam, the timing to close the electromagnetic spill valve is changed to control the quantity of fuel discharged from high-pressure fuel pump 200. During the pressurizing stroke in which the pump plunger is moved upward, the fuel of a larger quantity is discharged as the timing to close the electromagnetic spill valve is earlier, whereas the fuel of a smaller quantity is discharged as the timing to close the valve is later. The drive duty of the electromagnetic spill valve when the largest quantity of fuel is discharged is supposed to be 100%, and the drive duty of the electromagnetic spill valve when the smallest quantity of fuel is discharged is supposed to be 0%. When the drive duty of the electromagnetic spill valve is 0%, the electromagnetic spill valve remains open without closing. As long as the cam is rotating (as long as the engine is rotating), the pump plunger slides up and down. However, since the electromagnetic spill valve does not close, fuel is not pressurized. Thus, in the case where the engine is not rotating or the electromagnetic spill valve has its drive duty of 0%, if feed pump 100 is operated, fuel of a pressure which is approximately the feed pressure is supplied from high-pressure fuel pump 200 to high-pressure delivery pipe 112.

The fuel pressurized by high-pressure fuel pump 200 presses to open check valve 204 with the leakage function (having a set pressure of approximately 60 kPa), and the fuel is delivered via high-pressure delivery connection pipe 500 to high-pressure delivery pipe 112. At this time, the fuel pressure is controlled in a feedback manner by a fuel pressure sensor provided at high-pressure delivery pipe 112. High-pressure delivery pipe 112 for one of the V-shaped banks and high-pressure delivery pipe 112 for the other bank are connected by high-pressure connection pipe 520 as described above.

Check valve 204 with the leakage function is a check valve of a normal type in which pores are provided and the pores are always open. Therefore, when the fuel pressure within high-pressure fuel pump 200 (pump plunger) becomes lower than the fuel pressure within high-pressure delivery connection pipe 500 (for example, when the engine is stopped and accordingly the cam is stopped while the electromagnetic spill valve remains open), the high-pressure fuel within high-pressure delivery connection pipe 500 returns through the pores to high-pressure fuel pump 200, and accordingly the fuel pressure within high-pressure delivery connection pipe 500 as well as within high-pressure delivery pipe 112 lowers. As such, when the engine is stopped, for example, the fuel within high-pressure delivery pipe 112 does not have a high pressure, so that leakage of the fuel from in-cylinder injectors 110 can be prevented. Here, the check valve may not have such a leakage function.

Engine ECU 10 drives and controls in-cylinder injector 110 based on the final fuel injection quantity to control the quantity of fuel injected from in-cylinder injector 110. The quantity of fuel injected from in-cylinder injector 110 (fuel injection quantity) is determined by the pressure of fuel (fuel pressure) within high-pressure delivery pipe 112 and the fuel injection time. Therefore, it is necessary to maintain the fuel pressure at a proper level so as to provide a proper fuel injection quantity. Accordingly, engine ECU 10 performs feedback control of the fuel discharge quantity of high-pressure fuel pump 200 to maintain fuel pressure P at a proper value so that the fuel pressure obtained based on the detection signal from the fuel pressure sensor approaches the target fuel pressure which is set according to the operating state of the engine.

A feature of fuel supply system 11 for the engine in the present embodiment is that low-pressure delivery pipe 410 is provided with a non-return valve 412 and pump supply pipe 420 is provided with a non-return valve 422. Non-return valve 412 does not allow the flow of fuel from low-pressure delivery pipe 122 toward low-pressure supply pipe 400. Non-return valve 422 does not allow the flow of fuel from pump supply pipe 420 toward low-pressure supply pipe 400. In other words, although low-pressure delivery connection pipe 410 and pump supply pipe 420 communicate with each other at their branching point, these non-return valve 412 and non-return valve 422 prevent the fuel from flowing from low-pressure delivery connection pipe 410 of the low-pressure system to pump supply pipe 420 of the high-pressure system and the fuel from flowing from pump supply pipe 420 of the high-pressure system to low-pressure delivery connection pipe 410.

Therefore, when feed pump 100 is operated while engine is not rotating, the fuel is supplied to intake manifold injector 120 through low-pressure supply pipe 400, low-pressure delivery connection pipe 410, non-return valve 412 and low-pressure delivery pipe 122 in the low-pressure system, and the fuel is supplied to in-cylinder injector 110 through low-pressure supply pipe 400, non-return valve 422, pump supply pipe 420, high-pressure fuel pump 200, high-pressure delivery connection pipe 500, high-pressure connection pipe 520 and high-pressure delivery pipe 112 in the high-pressure system. In the low-pressure system as well as the high-pressure system, the pressure of fuel is approximately the feed pressure. The fuel, however, does not flow from the high-pressure system to the low-pressure system and from the low-pressure system to the high-pressure system.

Figure 2:
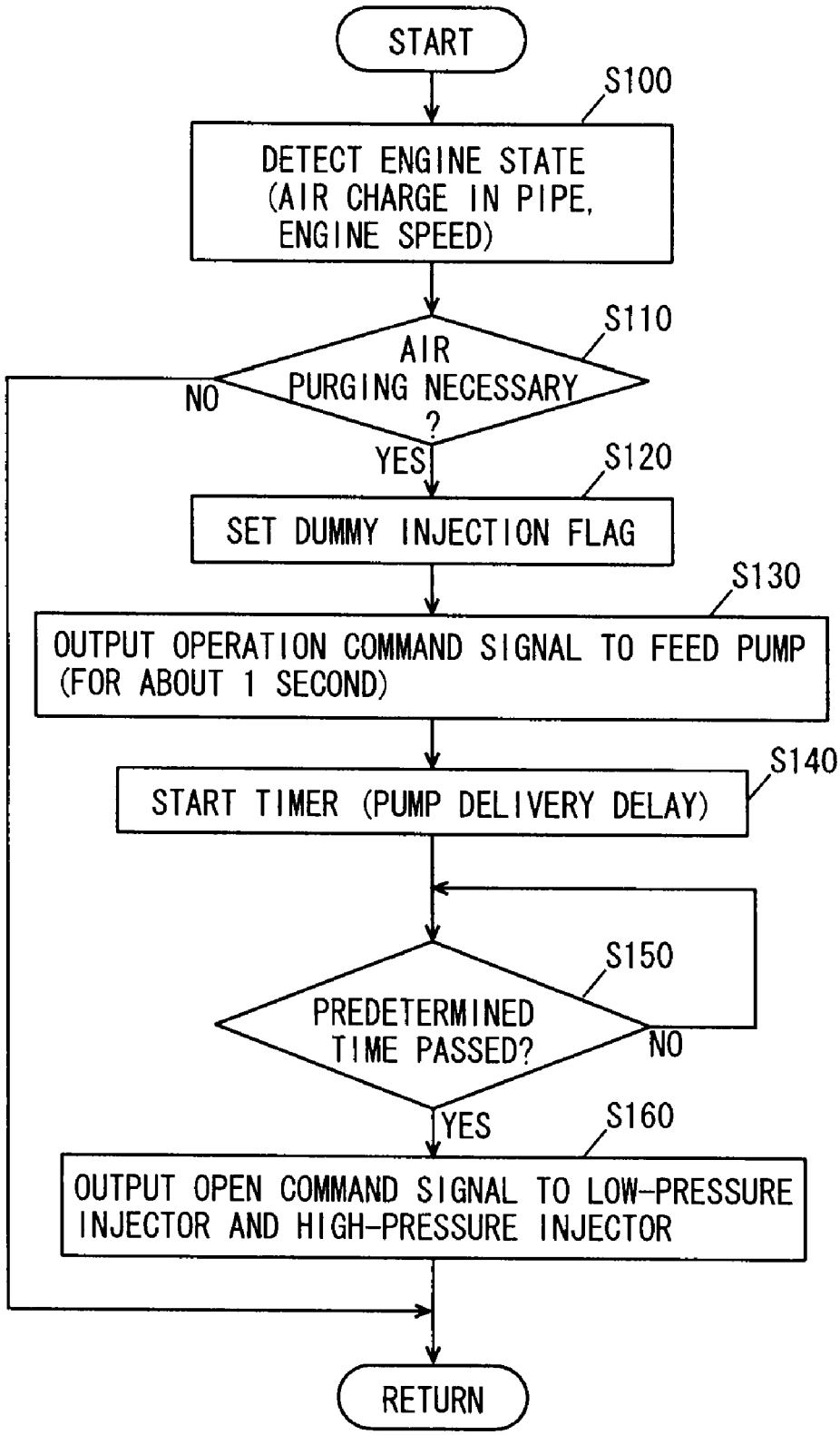
FIG. 2 is a flowchart showing a control structure of a program executed by an engine ECU that is the control device according to the first embodiment of the present invention.

Referring to FIG. 2, a description will be given of a control structure of a program executed by engine ECU 10 which is the control device in the present embodiment. Here, the air purging as illustrated below may use the air purging tool disclosed in Japanese Patent Laying-Open No. 08-158979 of the same applicant as the present application.

In step (hereinafter the step is abbreviated as S) 100, engine ECU 10 detects the engine state with sensors of various types. For example, such states as the air charge state in the pipe and the engine speed are detected.

In S110, engine ECU 10 determines whether or not air has to be purged. At this time, the in-delivery air collection determination routine for example as disclosed in Japanese Patent Laying-Open No. 2006-207453 of the same applicant as the present application may be used. When it is determined that the air purging is necessary (YES in S110), the process proceeds to S120. Otherwise (NO in S110), the process is ended.

In S120, engine ECU 10 sets a dummy injection flag. This flag is set from an OFF state to an ON state. The flag may be a one-shot ON signal or a signal keeping its ON state until the dummy injection is ended.

In S130, engine ECU 10 outputs an operation command signal to feed pump 100. Here, while this signal is output (for approximately one second for example), the feed pump is operated. In S140, engine ECU 10 starts a timer. The timer is used in consideration of the delivery delay time since the distance from feed pump 100 to intake manifold injector 120 of the low-pressure system as well as the distance therefrom to in-cylinder injector 110 of the high-pressure system are long.

In S150, engine ECU 10 determines whether or not a predetermined time has passed. The predetermined time refers to a set value of the timer in S140, and it is determined that the predetermined time has passed when the timer comes to the end. When a predetermined time has passed (YES in S150), the process proceeds to S160. Otherwise (NO in S150), the process returns to S150.

In S160, engine ECU 10 outputs an open command signal to intake manifold injector 120 of the low-pressure system and to in-cylinder injector 110 of the high-pressure system.

Figure 3:
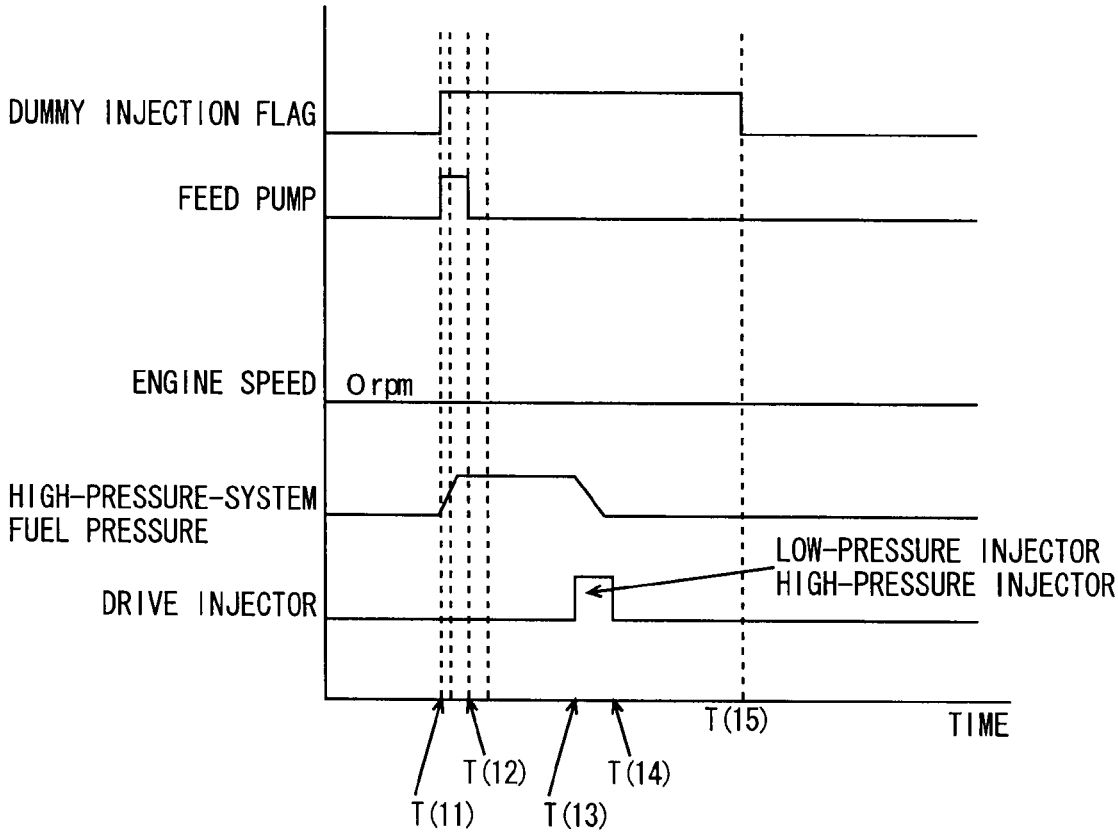
FIG. 3 is a timing chart in the case where the flowchart in FIG. 2 is followed.

With reference to FIG. 3, a description will be given of the air purging by engine ECU 10 which is the control device in the present embodiment, based on the above-described structure and flowchart.

The state of the vehicle is detected (S100). When it is determined that air has to be purged (YES in S110), the dummy injection flag is set to an ON state. The dummy injection flag is used for another control operation performed by engine ECU 10 (for example, when the flag is in the ON state, engine start control is not allowed to be performed). This state corresponds to time T (11) in FIG. 3. FIG. 3 is described here supposing that the dummy injection flag keeps the ON state until the air purging process is completed (the flag is set to an OFF state at time T (15) at which the air purging is fully completed).

In the period of approximately one second from time T (11) to time T (12), the operation command signal is output to feed pump 100 (S130). At time T (12), the fuel pressure of the high-pressure system that is detected by the fuel pressure sensor provided at high-pressure delivery pipe 112 has become high. Here, the fuel pressure of the high-pressure system is herein expressed as that of the high-pressure system, the pressure of the fuel detected by the fuel pressure sensor provided at high-pressure delivery pipe 112 is approximately equal to the feed pressure since the engine is not operated and high-pressure fuel pump 200 is not operated.

At time T (13) at which a predetermined time has passed from time T (11), the open command signal is output to intake manifold injector 120 of the low-pressure system and to in-cylinder injector 110 of the high-pressure system (S160). Here, the time for which the injectors are opened is the period from time T (13) to time T (14).

At this time, although low-pressure delivery connection pipe 410 and pump supply pipe 420 communicate with each other at the branching point, non-return valve 412 and non-return valve 422 do not allow the fuel to flow from low-pressure delivery connection pipe 410 of the low-pressure system to pump supply pipe 420 of the high-pressure system nor allow the fuel to flow from pump supply pipe 420 of the high-pressure system to low-pressure delivery connection pipe 410 of the low-pressure system. Therefore, the timing at which the air is purged from the low-pressure system by opening intake manifold injector 120 and the timing at which the air is purged from the high-pressure system by opening in-cylinder injector 110 may be simultaneous, or different and in this case which one of the timings may precede the other. In other words, since non-return valves 412 and 422 prevent the fuel from flowing back between the injector opened first and the injector opened next (or simultaneously), the fuel is not pushed out by the expanded air to the other fuel system.

In this way, the engine having the two fuel supply systems are provided with respective non-return valves for respective fuel supply systems in order to prevent backflow of the fuel from one fuel supply system to the other fuel supply system. Therefore, in the case where one fuel supply system performs dummy injection to purge air therefrom, the fuel pushed out by the air expanded in the other fuel supply system is prevented from being injected from the one injector performing the dummy injection.

Second Embodiment

In the following, a second embodiment of the present invention will be described. In the above-described first embodiment, the low-pressure fuel supply system and the high-pressure fuel supply system are provided with respective non-return valves. In the present embodiment, one non-return valve is provided. Specifically, in order to purge air, the dummy injection is performed from injectors at different times, and only one of the fuel supply systems purging the air therefrom later than the other fuel supply system is provided with the non-return valve.

Figure 4:
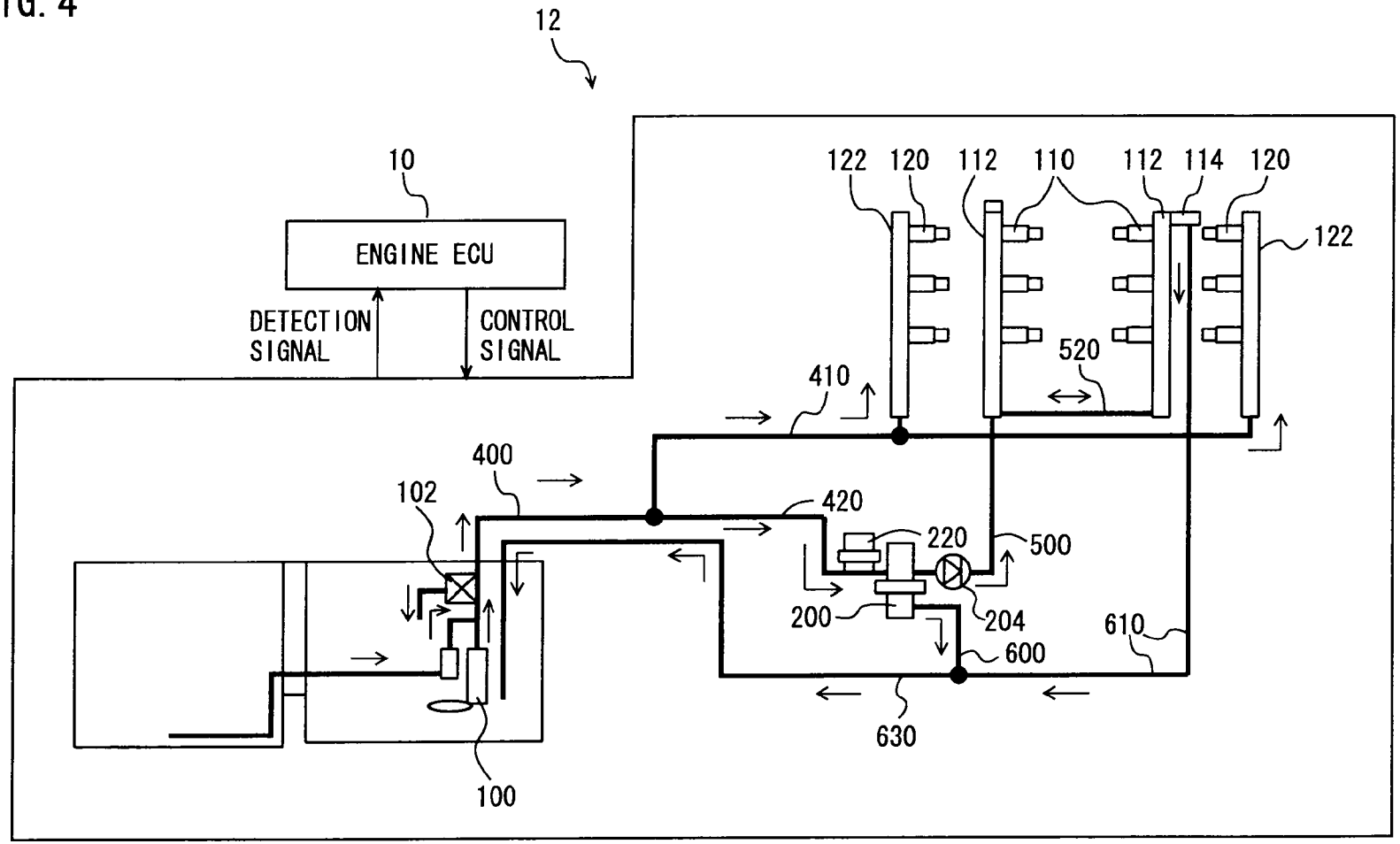
FIG. 4 is a schematic diagram of the whole fuel supply system for a gasoline engine that is controlled by a control device according to a second embodiment of the present invention.

Referring to FIG. 4 which corresponds to FIG. 1, a description will be given of a fuel supply system 12 for an engine controlled by engine ECU 10 which is a control device in the present embodiment. In the description of FIG. 4, the same component as that in FIG. 1 is denoted by the same reference character. These components have the same function. Therefore, the detailed description thereof will not be repeated. Here, engine ECU 10 is different only in terms of the program described hereinlater and has the same hardware configuration. Therefore, the engine ECU is denoted by the same reference character as that in the first embodiment.

As shown in FIG. 4, in fuel supply system 12 of the present embodiment, although pump supply pipe 420 should be provided with a non-return valve in the case where dummy injection is performed first from the low-pressure system, check valve 204 having the leakage function performs the function of this non-return valve. Like non-return valve 422, check valve 204 with the leakage function does not allow fuel to flow in the direction from pump supply pipe 420 toward low-pressure supply pipe 400. Namely, while low-pressure delivery connection pipe 410 and pump supply pipe 420 communicate with each other at the branching point, check valve 204 with the leakage function prevents fuel from flowing from pump supply pipe 420 of the high-pressure system to low-pressure delivery connection pipe 410 of the low-pressure system.

Therefore, if feed pump 100 is operated while engine does not rotate, fuel is supplied in the low-pressure system through low-pressure supply pipe 400, low-pressure delivery connection pipe 410 and low-pressure delivery pipe 122 to intake manifold injector 120. In the high-pressure system, fuel is supplied through low-pressure supply pipe 400, pimp supply pipe 420, high-pressure fuel pump 200, check valve 204 with the leakage function, high-pressure delivery connection pipe 500, high-pressure connection pipe 520 and high-pressure delivery pipe 112 to in-cylinder injector 110. In the low-pressure system as well as in the high-pressure system, the fuel pressure is approximately equal to the feed pressure. However, the fuel does not from the high-pressure system to the low-pressure system. Although check valve 204 with the leakage function has pores therein, it is the high-pressure fuel that passes through the pores and the fuel of approximately the feed pressure does not flow through these pores from the high-pressure system to the low-pressure system. Moreover, check valve 204 with the leakage function may be a check valve without such a leakage function.

In the configuration as described above, dummy injection is performed first from the low-pressure system. In the case where dummy injection is performed first from the high-pressure system, a non-return valve is necessary since the low-pressure system is not provided with check valve 204 with the leakage function.

Figure 5:
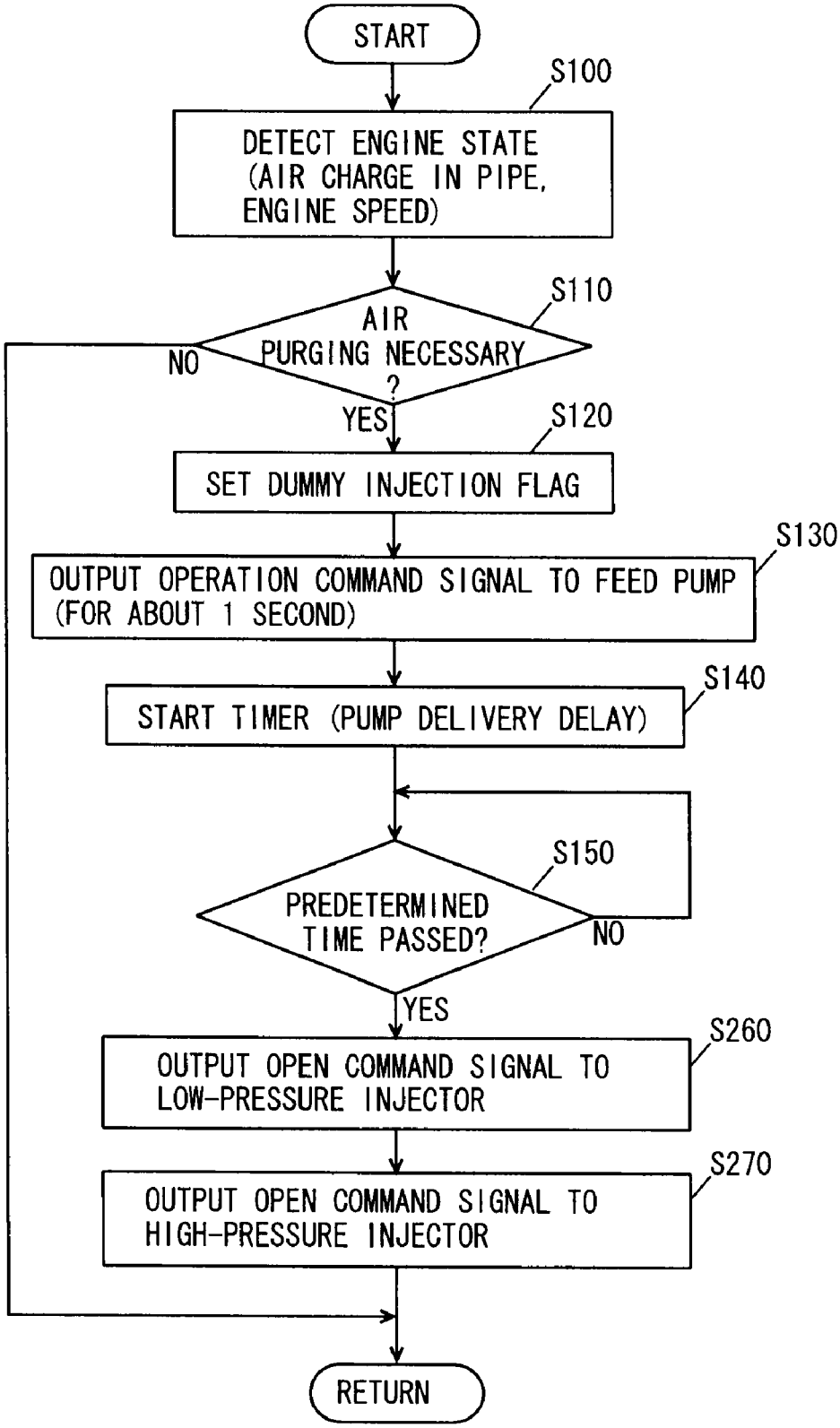
FIG. 5 is a flowchart showing a control structure of a program executed by an engine ECU that is the control device according to the second embodiment of the present invention.

Referring to FIG. 5 corresponding to FIG. 2, a description will be given of a control structure of the program executed by engine ECU 10 which is the control device in the present embodiment. Here, in the flowchart of FIG. 5, the same process step as the one in FIG. 2 is denoted by the same step number. The same operation is performed in these steps. Therefore, the detailed description thereof will not be repeated here. In FIGS. 5 and 2, the process steps to S150 are identical to each other.

In S260, engine ECU 10 outputs an open command signal to intake manifold injector 120 of the low-pressure system.

In S270, engine ECU 10 outputs an open command signal to in-cylinder injector 110 of the high-pressure system. Here, a predetermined time interval is given between S260 and S270 by a timer for example.

Figure 6:
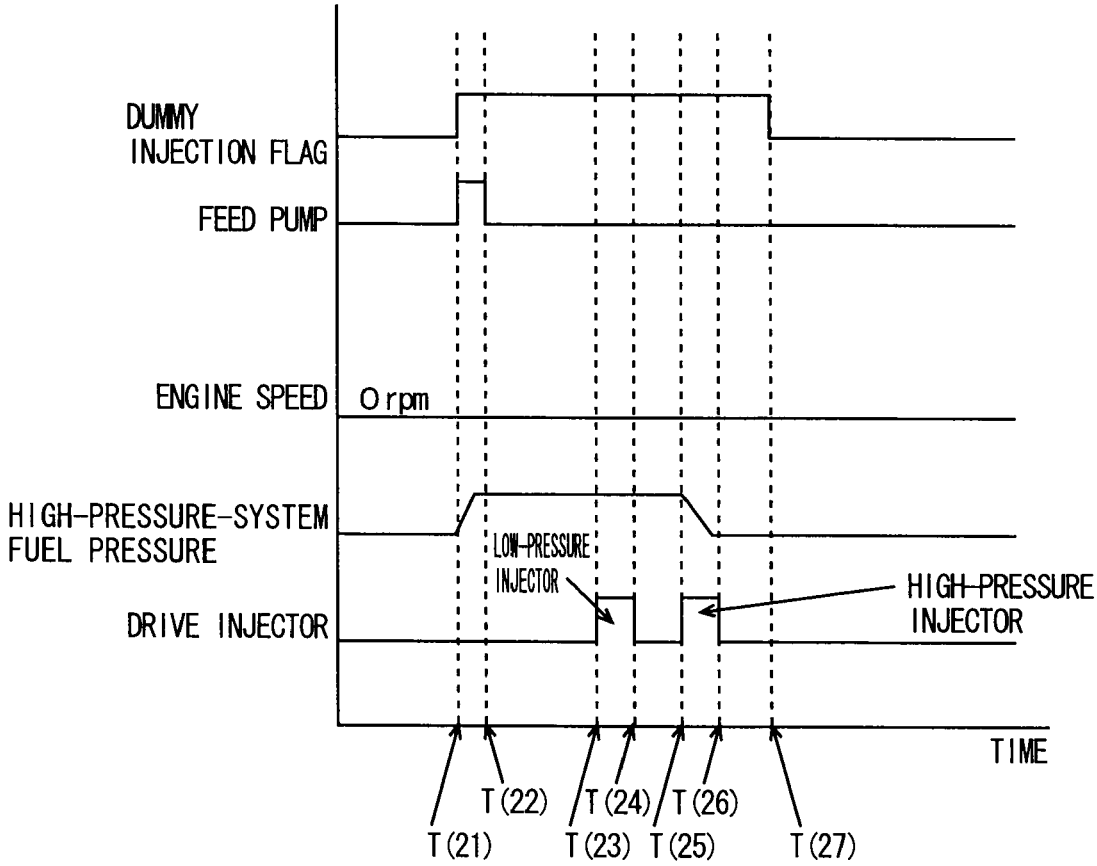
FIG. 6 is a timing chart in the case where the flowchart in FIG. 5 is followed.

With reference to FIG. 6 corresponding to FIG. 3, a description will be given of the air purging operation by engine ECU 10 which is the control device in the present embodiment, based on the above-described structure and flowchart. Here, the description of the same operation as that in the first embodiment will not be repeated.

The vehicle state is detected (S100). It is determined that air purging is necessary (YES in S110) and feed pump 100 is operated (S130). After this, the open command signal is output first to intake manifold injector 120 of the low-pressure system (S260). Here, the injector opens for the period from time T (23) to time T (24).

At this time, while low-pressure delivery connection pipe 410 and pump supply pipe 420 communicate with each other at the branching point, check valve 204 with the leakage function does not allow fuel to flow from pump supply pipe 420 of the high-pressure system to low-pressure delivery connection pipe 410 of the low-pressure system. Therefore, even when the air is purged from the low-pressure system by opening intake manifold injector 120 and the air of the high-pressure system expands to reach normal pressure, the fuel of the high-pressure system does not flow into low-pressure delivery connection pipe 410 to which intake manifold injector 120 which is opening is connected.

In other words, intake manifold injector 120 is the one which is opened first and in-cylinder injector 110 is the other one which is opened later, and the air expanded in the fuel system of the later opened injector does not cause fuel to be pushed out to the fuel system of intake manifold injector 120. It is supposed that, by time (25) at which a predetermined time has passed from time T (24) (or t (23)), the air of the low-pressure fuel system is completely discharged (namely no air collects in the low-pressure fuel system).

Then, an open command signal is output to in-cylinder injector 110 of the high-pressure system (S270). Here, the injector is opened for the period from time T (25) to time T (26). At this time, since no air collects in the low-pressure fuel system, it does not occur that air collecting in the low-pressure fuel system expands to normal pressure, and thus fuel does not flow from the low-pressure fuel system to the high-pressure fuel system from which dummy injection is performed.

Therefore, without non-return valve provided to the low-pressure fuel system, a non-return valve is provided to only the fuel supply system from which dummy injection is done later in time in the engine having the two fuel supply systems, in order to avoid backflow of the fuel to the fuel system from which the dummy injection is performed first. In particular, the check valve which is conventionally provided in the high-pressure system is used to function as a non-return valve. The resultant effect is therefore that it is necessary to newly provide a non-return valve to the high-pressure system. In this way, when air is purged from one of the fuel supply systems by dummy injection, fuel pushed out by the air expanded in the other fuel supply system can be prevented from being injected from the one injector performing the dummy injection.

In the second embodiment, the injector from which the dummy injection is performed first is intake manifold injector 120 of the low-pressure system, and check valve 204 with the leakage function additionally serves as a non-return valve to be provided to the high-pressure pipe. In the case where the injector performing the dummy injection first is in-cylinder injector 110 of the high-pressure system, a non-return valve has to be provided to a pipe of the low-pressure system since the low-pressure system does not have check valve 204 with the leakage function that can additionally serve as the non-return valve.

Moreover, the non-return valve in the first embodiment and the non-return valve in the second embodiment may be an open/close valve. The open/close valve is controlled by engine ECU 10 to implement the above-described function (the function of preventing fuel from flowing from the pipe of the injector different from the injector from which dummy injection is performed, to the pipe of the injector performing the dummy injection).

Third Embodiment

A third embodiment of the present invention will be described. In the above-described first embodiment, the low-pressure fuel supply system and the high-pressure fuel supply system are provided with respective non-return valves. In the second embodiment, the non-return valve is provided to only the fuel supply system performing dummy injection later in time. In the present embodiment, one three-way valve is provided at the branching point of low-pressure delivery connection pipe 410 and pump supply pipe 420. Specifically, according to the state of the three-way valve, dummy injection is performed from respective injectors of the fuel systems one by one.

Figure 7:
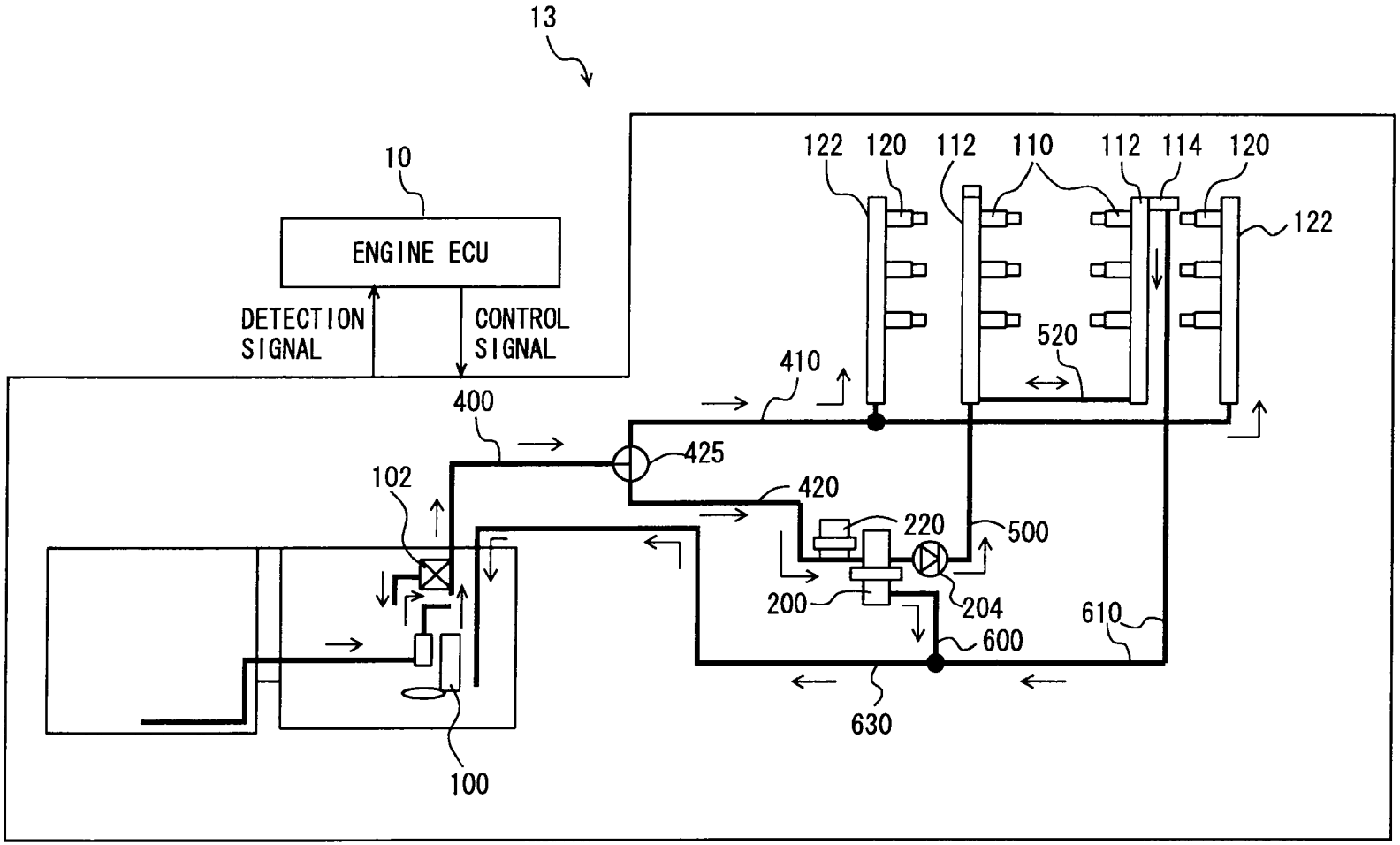
FIG. 7 is a schematic diagram of the whole fuel supply system for a gasoline engine that is controlled by a control device according to a third embodiment of the present invention.

Referring to FIG. 7 which corresponds to FIG. 1, a description will be given of a fuel supply system 13 for an engine controlled by engine ECU 10 which is a control device in the present embodiment. In the description of FIG. 7, the same component as that in FIG. 1 is denoted by the same reference character. These components have the same function. Therefore, the detailed description thereof will not be repeated. Here, engine ECU 10 is different only in terms of the program described hereinlater and has the same hardware configuration. Therefore, the engine ECU is denoted by the same reference character as that in the first embodiment.

As shown in FIG. 7, in fuel supply system 13 for the engine, one three-way valve 425 is provided at the branching point of low-pressure delivery connection pipe 410 and pump supply pipe 420. Three-way valve 425 is controlled by engine ECU 10 in the manner shown in FIG. 8.

Figure 8:
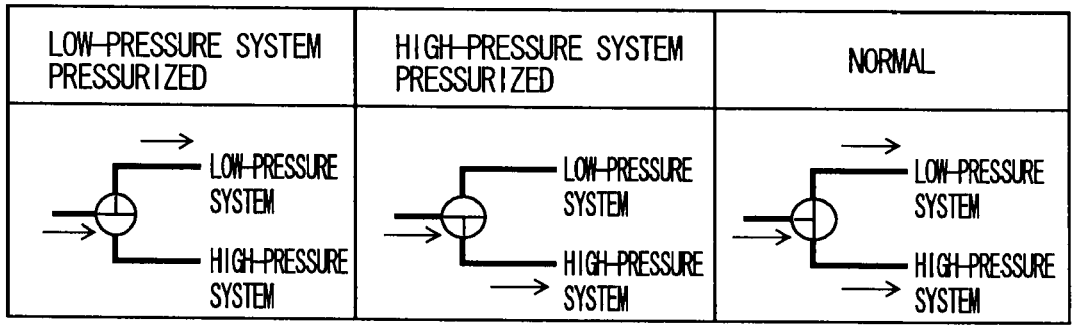
FIG. 8 illustrates an operating state of a three-way valve in FIG. 7.

As shown in FIG. 8, in response to a command signal from engine ECU 10, three-way valve 425 takes one of the normal state, the state of pressurizing the high-pressure system only and the state of pressurizing the low-pressure system only.

In the normal state, fuel is supplied to both of the low-pressure system (low-pressure delivery connection pipe 410) and the high-pressure system (pump supply pipe 420).

In the state of pressurizing the high-pressure system only, fuel is not supplied to the low-pressure system (low-pressure delivery connection pipe 410) but fuel is supplied to the high-pressure system (pump supply pipe 420) only. Here, fuel does not flow between low-pressure delivery connection pipe 410 of the low-pressure system and pump supply pipe 420 of the high-pressure system.

In the state of pressuring the low-pressure system only, fuel is supplied to the low-pressure system (low-pressure delivery connection pipe 410) only but fuel is not supplied to the high-pressure system (pump supply pipe 420). Here, fuel does not flow between low-pressure delivery connection pipe 410 of the low-pressure system and pump supply pipe 420 of the high-pressure system.

Figure 9:
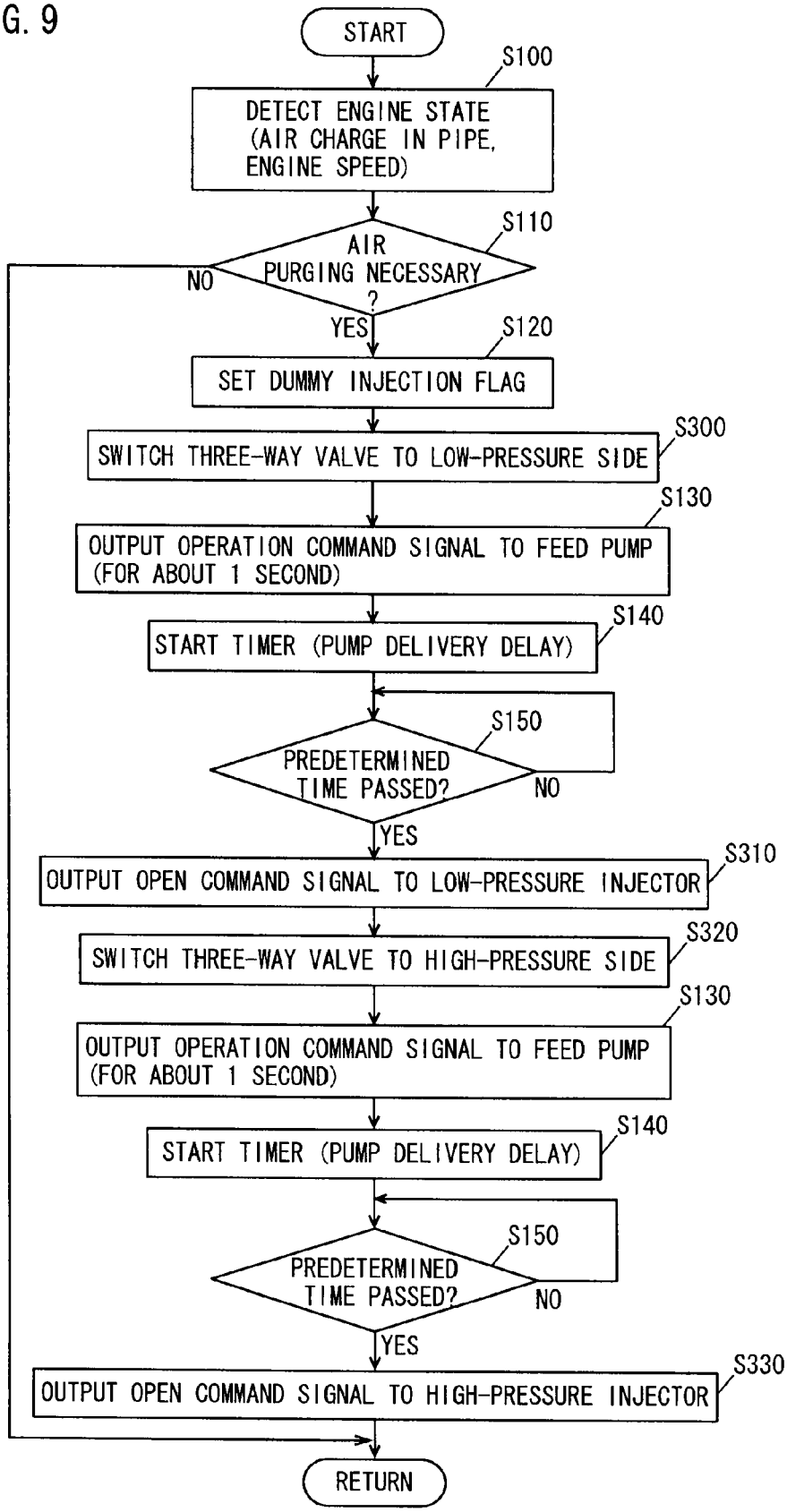
FIG. 9 is a flowchart showing a control structure of a program executed by an engine ECU that is the control device according to the third embodiment of the present invention.

Referring to FIG. 9 corresponding to FIG. 2, a description will be give of a control structure of the program executed by engine ECU 10 which is a control device in the present embodiment. Here, in the flowchart of FIG. 9, the same process step as the one in FIG. 2 is denoted by the same step number. The same operation is performed in these steps. Therefore, the detailed description thereof will not be repeated here.

In S300, engine ECU 10 switches three-way valve 425 to the low-pressure side (the state of pressurizing the low-pressure system in FIG. 8). In S310, engine ECU 10 outputs an open command signal to intake manifold injector 120 of the low-pressure system.

In S320, engine ECU 10 switches three-way valve 425 to the high-pressure side (the state of pressurizing the high-pressure system in FIG. 8). In S330, engine ECU 10 outputs an open command signal to in-cylinder injector 110 of the high-pressure system. Here, between S310 and S330, a predetermined time interval is given including the switching of three-way valve 425.

Figure 10:
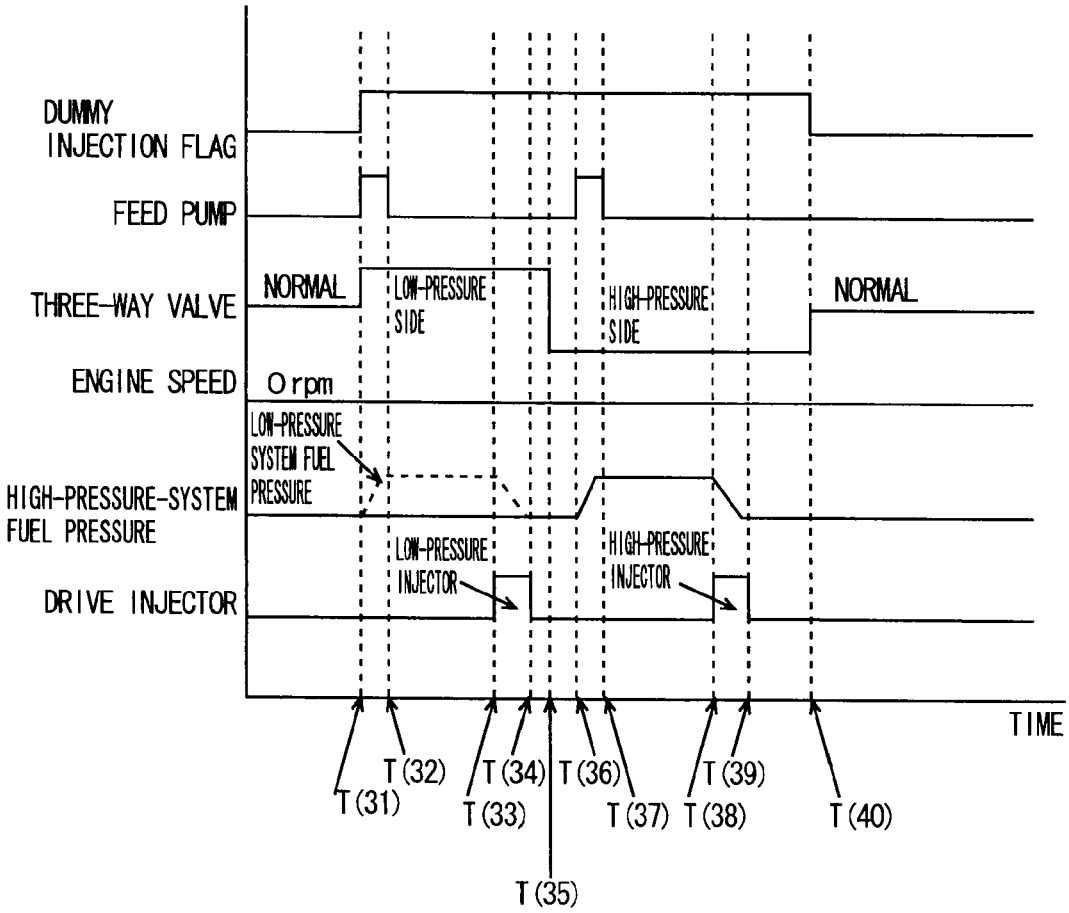
FIG. 10 is a timing chart in the case where the flowchart in FIG. 9 is followed.

Referring to FIG. 10 corresponding to FIG. 3, a description will be given of the air purging operation by engine ECU 10 which is the control device in the present embodiment, based on the above-described structure and flowchart. Here, the description of the same operation as that in the first embodiment will not be repeated.

The vehicle state is detected (S100). When it is determined that air purging is necessary (YES in S110), three-way valve 425 is switched to the low-pressure side (S300). After feed pump 100 is operated (S130), an open command signal is output to intake manifold injector 120 of the low-pressure system (S310). The injector is opened for the period from time T (33) to time T (34).

At this time, while low-pressure delivery connection pipe 410 and pump supply pipe 420 communicate with each other at the branching point, three-way valve 425 does not allow fuel to flow from pump supply pipe 420 of the high-pressure system to low-pressure delivery connection pipe 410 of the low-pressure system. Therefore, even if intake manifold injector 120 is opened to purge air from the low-pressure system and the air in the high-pressure system expands to normal pressure, fuel of the high-pressure system does not flow into low-pressure delivery connection pipe 410 to which the opening intake manifold injector is connected.

Then, three-way valve 425 is switched to the high-pressure side (S320). After feed pump 100 is operated (S130), an open command signal is output to in-cylinder injector 110 of the high-pressure system (S310). Here, the injector is opened for the period from time T (38) to time T (39).

At this time, while low-pressure delivery connection pipe 410 and pump supply pipe 420 communicate with each other at the branching point, three-way valve 425 does not allow fuel to flow from low-pressure delivery connection pipe 410 of the low-pressure system to pump supply pipe 420 of the high-pressure system. Therefore, even if in-cylinder injector 110 is opened to purge air from the high pressure system and the air if remaining in the low-pressure system expands to normal pressure, fuel of the low-pressure system does not flow into high-pressure delivery connection pipe 500 to which opening in-cylinder injector 110 is connected.

Thus, in the engine having the two fuel supply systems, the three-way valve is provided at the branching point of the high-pressure system and the low-pressure system to avoid backflow of the fuel from the fuel system which does not perform dummy injection to the fuel system which performs dummy injection. In this way, when air is purged from one fuel supply system by dummy injection, the fuel pushed out by the air expanded in the other fuel supply system can be prevented from being injected from the one injector performing the dummy injection.

In the third embodiment, it is apparently seen that the order of dummy injection between the low-pressure system and the high-pressure system can be reversed by changing the control of the three-way valve.

It should be understood that the embodiments disclosed herein are illustrative and non-restrictive in every respect. The scope of the invention is defined by the claims, rather than the description above, and is intended to include all modifications equivalent in meaning and scope to the claims.

The invention claimed is:

1. A control device for an internal combustion engine including a first fuel injection mechanism injecting fuel into a cylinder and a second fuel injection mechanism injecting fuel into an intake manifold, comprising:

a pump control unit that controls a fuel pump to supply fuel to said first fuel injection mechanism and said second fuel injection mechanism;

a control unit that opens at least one of the first fuel injection mechanism and the second fuel injection mechanism during an air purging operation, and that operates said fuel pump to purge air from at least one of a first fuel pipe from said fuel pump to said first fuel injection mechanism and a second fuel pipe from said fuel pump to said second fuel injection mechanism; and a break valve that breaks, when one of said first fuel injection mechanism and said second fuel injection mechanism is opened during the air purging operation, fluid communication between the first fuel pipe and the second fuel pipe, the break valve being provided to one of said first fuel pipe and said second fuel pipe and located respectively between the first and second fuel injection mechanisms and a branching point where a pipe from a fuel tank branches into said first fuel pipe and said second fuel pipe, wherein the break valve inhibits fuel from flowing in a direction from a respective one of said first and second fuel injection mechanisms toward said branching point, and wherein said control unit opens said first fuel injection mechanism and said second fuel injection mechanism at different times during the air purging operation such that one of the first and second fuel injection mechanisms is opened later than the other, said break valve being provided to the one of the first or second fuel pipes that is provided with the one of the first or second fuel injection mechanism that is opened later.

2. The control device for the internal combustion engine according to claim 1, wherein said break valve is a non-return valve inhibiting fuel from flowing in the direction from said fuel injection mechanisms toward said branching point.

3. The control device for the internal combustion engine according to claim 1, wherein said control unit controls to open said first and second fuel injection mechanisms at different times during the air purging operation such that said second fuel injection mechanism is opened earlier than said first fuel injection mechanism, and a non-return valve provided on an output side of a high-pressure fuel pump provided to said first fuel pipe additionally serves as said break valve.

4. The control device for the internal combustion engine according to claim 1, wherein said break valve is an open/close valve that is switched, by an open/close valve control unit, between a state of allowing fuel to flow, and a state of inhibiting fuel from flowing, in a direction from the respective one of said first and second fuel injection mechanisms toward the branching point where the pipe from the fuel tank branches into said first fuel pipe and said second fuel pipe.

5. A control device for an internal combustion engine including a first fuel injection mechanism injecting fuel into a cylinder and a second fuel injection mechanism injecting fuel into an intake manifold, comprising:

a pump control unit that controls a fuel pump to supply fuel to said first fuel injection mechanism and said second fuel injection mechanism;

a control unit that opens at least one of the first fuel injection mechanism and the second fuel injection mechanism during an air purging operation, and that operates said fuel pump to purge air from at least one of a first fuel pipe from said fuel pump to said first fuel injection mechanism and a second fuel pipe from said fuel pump to said second fuel injection mechanism; and a break unit that breaks, when one of said first fuel injection mechanism and said second fuel injection mechanism is opened during the air purging operation, fluid communication between the first fuel pipe and the second fuel pipe, the break unit including a first break valve provided to said first fuel pipe and a second break valve provided to said second fuel pipe, said first break valve being located between the first fuel injection mechanism and a branching point where a pipe from a fuel tank branches into said first fuel pipe and said second fuel pipe, and said second break valve being located between the second fuel injection mechanism and the branching point where the pipe from the fuel tank branches into said first fuel pipe and said second fuel pipe, wherein the first and second break valves respectively inhibit fuel from flowing in a direction from a respective one of said first and second fuel injection mechanisms toward said branching point.

6. The control device for the internal combustion engine according to claim 5, wherein said first and second break valves are non-return valves that respectively inhibit fuel from flowing in the direction from the respective one of said first and second fuel injection mechanisms toward said branching point.

7. The control device for the internal combustion engine according to claim 5, wherein at least one of said first and second break valves is an open/close valve that is switched, by an open/close valve control unit, between a state of allowing fuel to flow, and a state of inhibiting fuel from flowing, in a direction from the respective one of said first and second fuel injection mechanisms toward the branching point where the pipe from the fuel tank branches into said first fuel pipe and said second fuel pipe.

8. A control device for an internal combustion engine including a first fuel injection mechanism injecting fuel into a cylinder and a second fuel injection mechanism injecting fuel into an intake manifold, comprising:

a pump control unit that controls a fuel pump to supply fuel to said first fuel injection mechanism and said second fuel injection mechanism;

a control unit that opens at least one of the first fuel injection mechanism and the second fuel injection mechanism during an air purging operation, and that operates said fuel pump to purge air from at least one of a first fuel pipe from said fuel pump to said first fuel injection mechanism and a second fuel pipe from said fuel pump to said second fuel injection mechanism;

a three-way valve provided at a branching point where a pipe from a fuel tank branches into said first fuel pipe and said second fuel pipe; and a three-way valve control unit that controls said three-way valve such that said three-way valve is switched between a first state where fuel flows from said fuel tank to said first fuel pipe only, a second state where fuel flows from said fuel tank to said second fuel pipe only and a third state where fuel flows from said fuel tank to said first fuel pipe and said second fuel pipe.

9. The control device for the internal combustion engine according to claim 8, wherein, during the air purging operation, the three-way valve control unit initially switches the three-way valve to the first state, and, after the air purged from the first fuel pipe, switches the three-way valve to the second state.

10. The control device for the internal combustion engine according to claim 8, wherein, during the air purging operation, the three-way valve control unit initially switches the three-way valve to the second state, and, after the air purged from the second fuel pipe, switches the three-way valve to the first state.

* * * * *